US011657926B2

(12) United States Patent
Garolfi et al.

(10) Patent No.: US 11,657,926 B2
(45) Date of Patent: May 23, 2023

(54) FLEXIBLE POWER AND/OR CONTROL CABLE FOR USE ON MOVING APPLICATIONS

(71) Applicant: Prysmian S.p.A., Milan (IT)

(72) Inventors: Ferruccio Garolfi, Caselle Lurani (IT); Valerio Angelo Brambati, San Giuliano Milanes (IT); Elena Roda, Segrate (IT)

(73) Assignee: Prysmian S.p.A., Milan (IT)

( * ) Notice: Subject to any disclaimer, the term of this patent is extended or adjusted under 35 U.S.C. 154(b) by 0 days.

(21) Appl. No.: 17/465,516

(22) Filed: Sep. 2, 2021

(65) Prior Publication Data

US 2022/0130574 A1 Apr. 28, 2022

(30) Foreign Application Priority Data

Oct. 22, 2020 (IT) ..... 102020000025045

(51) Int. Cl.
*H01B 7/18* (2006.01)
*H01B 7/04* (2006.01)

(52) U.S. Cl.
CPC ..... *H01B 7/18* (2013.01); *H01B 7/041* (2013.01)

(58) Field of Classification Search
CPC ..... H01B 7/18; H01B 7/041
USPC ..... 174/113 R
See application file for complete search history.

(56) References Cited

U.S. PATENT DOCUMENTS

| | | | | |
|---|---|---|---|---|
| 2,583,026 A | 1/1952 | Swift | | |
| 4,401,366 A * | 8/1983 | Hope | G02B 6/4407 | 385/113 |
| 5,742,008 A * | 4/1998 | Dalrymple | H01B 7/0869 | 174/99 R |
| 7,054,531 B2 * | 5/2006 | Hurley | G02B 6/441 | 385/103 |
| 7,974,507 B2 * | 7/2011 | Lovie | G02B 6/4464 | 385/100 |
| 8,913,862 B1 * | 12/2014 | Emmerich | G02B 6/4429 | 385/103 |
| 2003/0035635 A1 * | 2/2003 | Chastain | G02B 6/4401 | 385/103 |
| 2005/0094953 A1 * | 5/2005 | Park | G02B 6/4438 | 385/103 |
| 2006/0127015 A1 * | 6/2006 | Donetti | G02B 6/4494 | 385/112 |

(Continued)

FOREIGN PATENT DOCUMENTS

| | | |
|---|---|---|
| CN | 206075924 U | 4/2017 |
| CN | 110491590 A | 11/2019 |
| EP | 3637164 A1 | 4/2020 |

*Primary Examiner* — Timothy J Thompson
*Assistant Examiner* — Michael F McAllister
(74) *Attorney, Agent, or Firm* — Slater Matsil, LLP

(57) ABSTRACT

The present disclosure relates to a flexible cable for use in moving applications, comprising: one or more insulated cores; a filler layer surrounding the one or more insulated cores, having an external surface defining a filler layer external perimeter substantially forming a closed convex polygonal chain with a plurality of line segments connecting consecutive vertices; and an outer sheath surrounding the filler layer and directly applied on the filler layer, having an external surface defining an outer sheath external perimeter forming a continuous closed curve.

21 Claims, 2 Drawing Sheets

(56) References Cited

U.S. PATENT DOCUMENTS

| | | | | |
|---|---|---|---|---|
| 2009/0003780 | A1* | 1/2009 | Bringuier | G02B 6/4494 264/1.27 |
| 2015/0086168 | A1* | 3/2015 | Blazer | G02B 6/4486 156/85 |
| 2015/0293321 | A1* | 10/2015 | Blazer | G02B 6/4413 57/7 |
| 2016/0141070 | A1* | 5/2016 | Heipel | H01B 7/24 174/72 A |
| 2016/0202437 | A1 | 7/2016 | Emmerich et al. | |
| 2016/0233007 | A1* | 8/2016 | Truong | H01B 13/24 |
| 2016/0295754 | A1* | 10/2016 | Huang | H01B 11/00 |
| 2016/0313529 | A1* | 10/2016 | Baucom | G02B 6/4433 |
| 2016/0360654 | A1* | 12/2016 | Nakatani | H01B 11/1025 |
| 2017/0131496 | A1* | 5/2017 | Blazer | E21B 47/135 |
| 2018/0190410 | A1* | 7/2018 | Cao | H01B 9/006 |
| 2019/0222014 | A1* | 7/2019 | Lang | G02B 6/4433 |
| 2020/0319417 | A1* | 10/2020 | Kamath | E21B 47/135 |

* cited by examiner

FLEXIBLE POWER AND/OR CONTROL CABLE FOR USE ON MOVING APPLICATIONS

CROSS-REFERENCE TO RELATED APPLICATIONS

This application claims the benefit of Italian Patent Application No. 102020000025045 filed on Oct. 22, 2020, which application is hereby incorporated herein by reference.

TECHNICAL FIELD

The present disclosure relates to a flexible power and/or control cable for use in moving applications.

BACKGROUND

Flexible cables for the above-mentioned applications comprise an electrically insulating inner sheath, for example made of a rubber, enveloping a plurality of cores, for example including phase conductors and/or optical fibers, as well as other possible components depending on the cable type, such as earth conductors. An outer sheath envelops the inner sheath. In cross section, the inner sheath external surface and the outer sheath inner surface have a circular perimeter, therefore the external sheath, under torsional stress, tends to torsionally slide relative to the inner sheath. In order to avoid such sliding and possible detachments of the outer sheath from the inner sheath, the known flexible cables comprise an anti-swinging protection, for example a synthetic thread embedded at the interface of the outer and the inner sheaths.

U.S. Pat. No. 2,583,026 A describes a cable comprising two stranded conductors, a conductor insulation around each conductor and an external sheath surrounding the whole. The conductor insulation is formed so that its external surface is corrugated to comprise alternate ribs separated by grooves. The material of the ribbed insulation is a rubber insulating compound, i.e. an elastomer. However, the use of elastomers in combination with the corrugated external surface is problematic from a manufacturing point of view because filling the grooves is difficult and consequently the resulting mechanical properties can be poor. Additionally, the corrugated shape with alternating ribs and grooves requires suitable widths in order to avoid possible breaks in the rubber.

Other peculiar cables not for use in moving applications can present an outer sheath surrounding a not circular layer, such as in some examples listed below.

CN 110491590 A discloses a Halogen-free low-smoke flame-retardant cable having three conductors wherein the cross section of the first insulating sleeve around the conductors is annular, the cross section of the second insulating sleeve is in a special annular shape with an outer square and an inner circle, and the cross section of the flame-retardant outer sleeve is in an hexagonal annular shape.

CN 206075924 U discloses a fire retardant and fire resistant type cable of high strength, comprising a cross section of insulating layer being a regular octagon, eight cable core settings in the cross section being regular octagon's polyester frame, wherein the insulated wire cross section of cable core is a regular octagon, and eight cable cores are arranged in proper order.

EP 3 637 164 A1 discloses a shotgun resistant fiber optic loose tube cable comprising a non-metallic central strength element, an outer sheath, made of PE, an inner sheath, water swellable yarns and a protection strength element which comprises flat Fiber Reinforced Plastic elements arranged in polygonal manner.

SUMMARY

An embodiment flexible cable for use in moving applications includes one or more insulated cores, a filler layer surrounding the one or more insulated cores, and an outer sheath surrounding the filler layer and directly applied on the filler layer. The filler layer has an external surface defining a filler layer external perimeter that substantially forms a closed convex polygonal chain with a plurality of line segments connecting consecutive vertices. The outer sheath has an external surface defining an outer sheath external perimeter forming a continuous closed curve.

BRIEF DESCRIPTION OF THE DRAWINGS

Further characteristics and advantages will be more apparent from the following description of some embodiments given as a way of an example with reference to the enclosed drawings in which.

DETAILED DESCRIPTION OF ILLUSTRATIVE EMBODIMENTS

Figure 1:
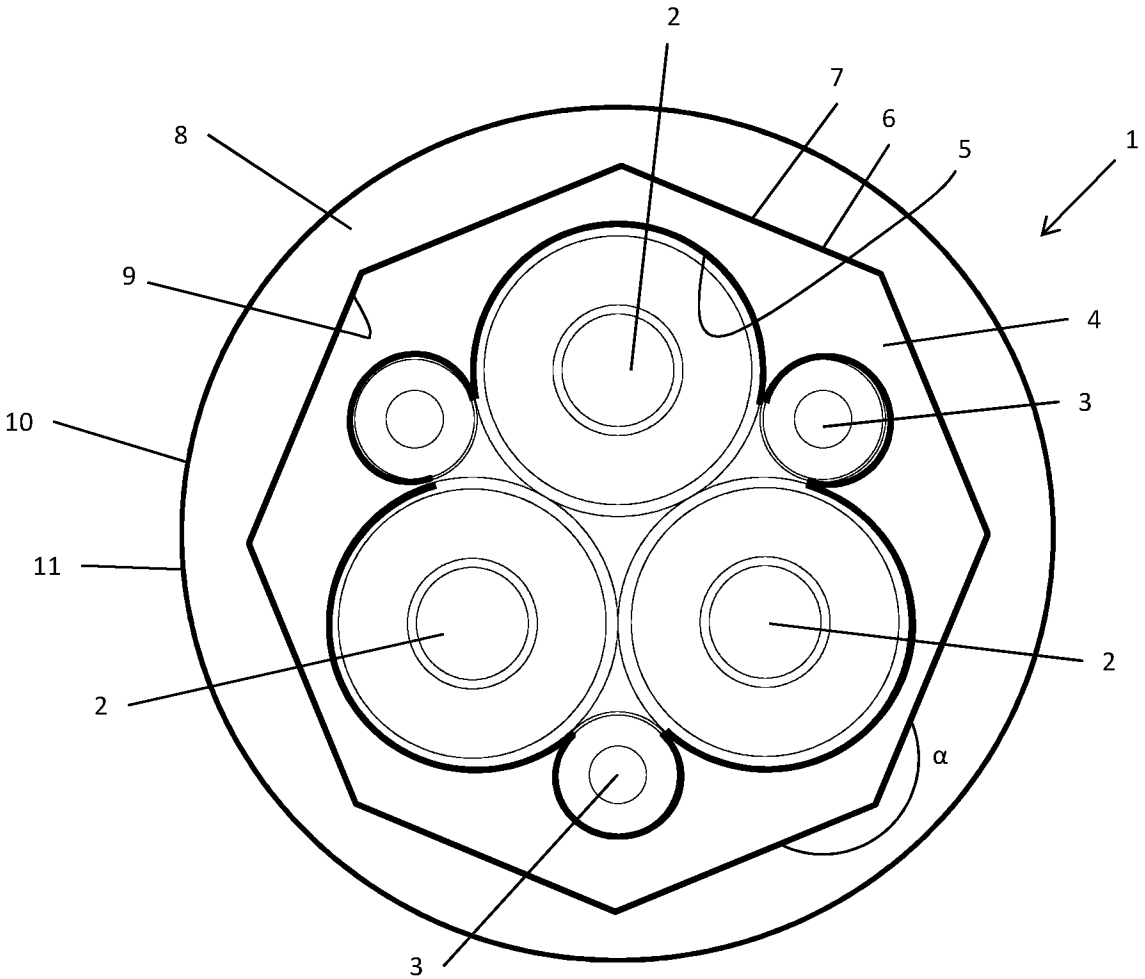
FIG. 1 shows a sectional view of a flexible cable according to an embodiment of the present disclosure.

In the following description, same alphanumeric references are used for analogous exemplary elements when they are depicted in different drawings.

For the purpose of the present description and of the appended claims, the words "a" or "an" should be read to include one or at least one and the singular also includes the plural unless it is obvious that it is meant otherwise. This is done merely for convenience and to give a general sense of the disclosure.

The present disclosure, in at least one of the aforementioned aspects, can be implemented according to one or more of the following embodiments, optionally combined together.

The present disclosure relates to a flexible power and/or control cable for use in moving applications. Particularly, the present disclosure relates to a cable for example suitable for use in three-phase AC, and/or single phase AC, and/or DC installations, and/or suitable for transmitting signals or data, for example including optical fibers. The cable of the present disclosure is a flexible cable for example for use on connecting movable parts of machine tools or any material handling equipment associated to high mechanical stresses, frequent bending or torsional operations or fast movements with high accelerations.

Embodiments of this application provide a flexible cable for use on movable parts with an improved torsional resistance. This is achieved by a flexible cable having a filler layer housing one or more insulated cores and having a polygonal shaped external contour and an outer sheath, having an outer circular contour, directly applied on the external polygonal shaped contour of the filler layer. Experimental tests have shown that the torsional movements of the outer sheath with respect to the inner filler layer are significantly lower than those of the outer sheath with respect to the inner sheath in a comparable flexible cable according to the prior art under the same torsional stress conditions. The flexible cable according to the present disclosure is externally rounded, particularly circular, like the flexible cables according to the prior art. Therefore, a flexible cable of the prior art can be easily substituted with the flexible cable of the present disclosure with higher torsional strength.

Accordingly, the present disclosure relates to a flexible cable for use in moving applications, comprising: one or more insulated cores; a filler layer surrounding the one or more insulated cores, having an external surface defining a filler layer external perimeter substantially forming a closed convex polygonal chain with a plurality of line segments connecting consecutive vertices; and an outer sheath surrounding the filler layer and directly applied on the filler layer, having an external surface defining an outer sheath external perimeter forming a continuous simple closed curve.

In an embodiment, the outer sheath has an internal surface radially opposite to the outer sheath external surface, wherein the outer sheath internal surface is in direct contact with and conforms to the filler layer external surface.

In an embodiment, the flexible cable comprises an anti-swinging device at the interface of the outer sheath internal surface and the filler layer external surface.

In an embodiment, the anti-swinging device comprises one or more embedded threads.

In an embodiment, the line segments of the filler layer external perimeter are straight line segments or curved line segments.

In an embodiment, the curved line segments of the filler layer external perimeter are convex.

In an embodiment, the vertices of the filler layer external perimeter are shaped as points where two consecutive line segments meet.

In an embodiment, the vertices of the filler layer external perimeter are rounded.

In an embodiment, the number of vertices of the filler layer external perimeter is at least 4, preferably ranging between 6 and 12, wherein 6 and 12 are included in the range.

In an embodiment, the filler layer external perimeter substantially forms a regular octagon.

In an embodiment, the filler layer is formed by extrusion around the one or more insulated cores.

In an embodiment, the outer sheath external perimeter is substantially circular.

In an embodiment, the one or more insulated cores comprises at least a power conductor.

In an embodiment, the outer sheath is applied onto the filler layer by extrusion. In an embodiment, the filler layer and the outer sheath are made of a polymer selected in the group consisting of: a cross-linked elastomer including any of: a synthetic rubber, Polychloroprene, Chlorosulfonated Polyethylene, a halogen-free cross-linked elastomer; a thermoplastic polymer including any of: Polyethylene, cross-linked Polyethylene, Polypropylene, Polyvinyl Chloride, Polyurethane, Polyester, a halogen-free thermoplastic polymer), and any combination thereof.

In an embodiment, the filler layer and the outer sheath are both made of a cross-linked elastomer.

Figure 2:
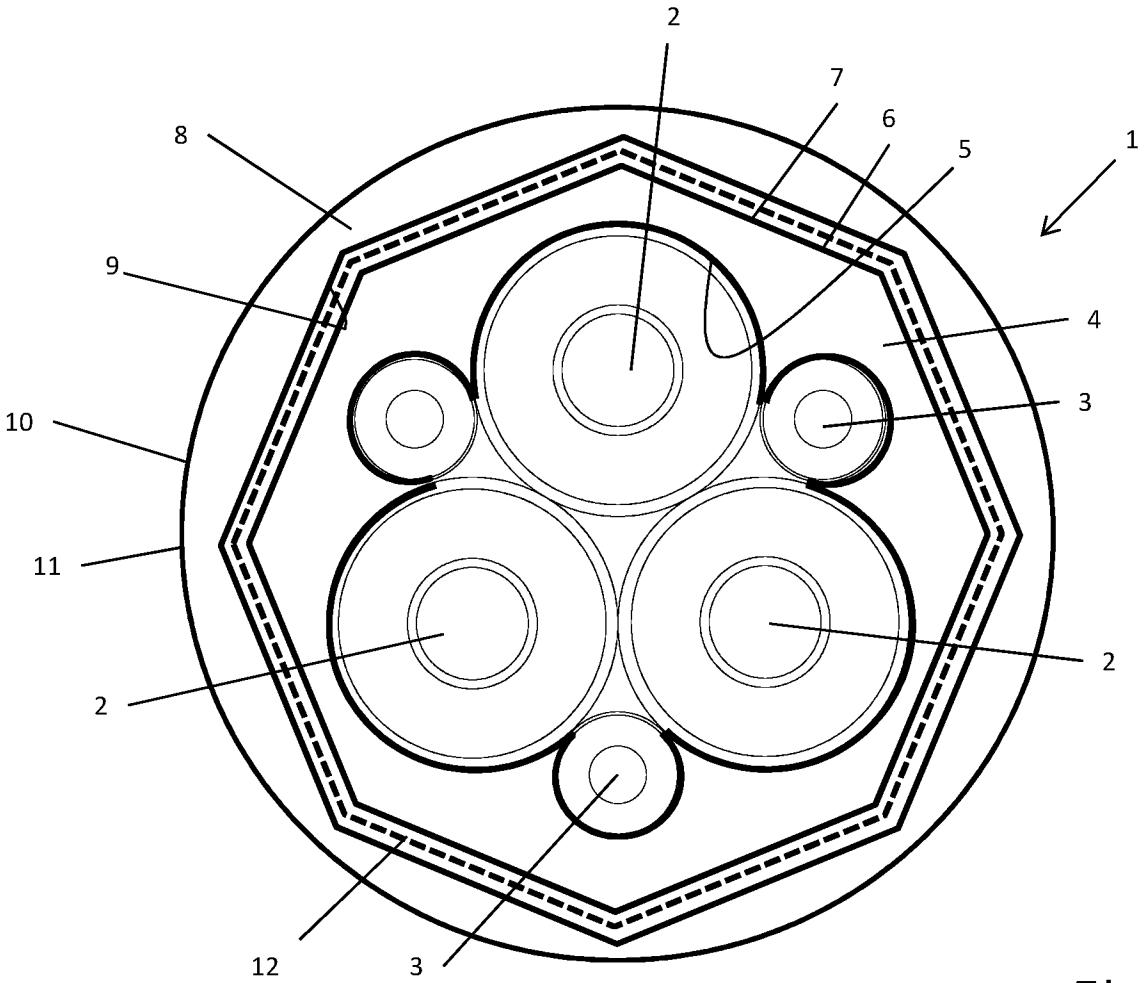
FIG. 2 shows a sectional view of a flexible cable according to another embodiment of the present disclosure.

With reference to the attached FIGS. 1-2, a flexible cable is indicated with reference number 1. The flexible cable 1 comprises one or more cores, which can be of different types. For example, the one or more cores can comprise three-phase AC conductors, and/or single phase AC conductors, and/or DC conductors, and/or data transmitting devices, such as optical fibers. Depending on the type, each core can comprise additional layers such as screens, electrical insulations etc., as will be apparent to those skilled in the art. However, most of the embodiments of this invention includes at least an electrically insulated core including a power conductor having a conductor section of at least 25 $mm^2$. In the embodiments shown in the FIGS. 1-2 merely by way of example, the cable 1 comprises three insulated AC conductors 2 and three insulated earth conductors 3 in triangular arrangements.

The flexible cable 1 comprises a filler layer 4 enveloping the one or more insulated cores. The filler layer 4 comprises an annular body, longitudinally extending along the cable length, housing the one or more cores in its hollow part, and having an internal surface 5, facing the cores, and an external surface 6, radially opposite to the internal surface 5.

In a cross section on a plane orthogonal to the cable 1 longitudinal axis, corresponding to the filler layer 4 annular body longitudinal axis, the external surface 6 defines a filler layer external perimeter 7 substantially forming a closed polygonal chain having a plurality of line segments connecting consecutive vertices. The closed polygonal chain is convex, i.e. the external angles $\alpha$ at all the vertices are greater than 180° (see e.g. FIG. 1). With this configuration, the mechanical characteristics of the cable may be improved without creating protuberances or grooves of the filler layer 4.

The line segments can be either straight line segments or curved line segments (i.e. arcs), for example convex curved line segments.

The term "vertices" can be interpreted according to the strict geometric definition, i.e. points where two consecutive lines or curves meet. According to this interpretation, at least macroscopically, the vertices do not have a finite radius of curvature. Alternatively, the vertices are rounded, i.e. they comprise arcs connecting two consecutive line segments. In embodiments comprising curved line segments and rounded vertices, the radius of curvature of the rounded vertices is smaller than the radius of curvature of the curved line segments.

From the definitions of "line segments" and "vertices" given above follows that the filler layer external perimeter 7 does not necessarily form a geometrically ideal closed polygonal chain but it can approximates it (the above-mentioned "substantially forming a closed polygonal chain" is to be interpreted in this sense).

In the examples of FIGS. 1 and 2, the vertices are points connecting consecutive straight line segments of the filler layer external perimeter 7.

The number of vertices depends on the cores number, diameters and arrangement. In an embodiment, the number of vertices is at least 4, preferably ranging between 6 and 12 (wherein 6 and 12 are to be considered included in the range 6-12). In the exemplary embodiments of FIGS. 1 and 2, the filler layer external perimeter 7 substantially defines a regular octagon, having a number of vertices equal to 8.

The filler layer 4 is deformable and can be formed by extrusion around the cores.

The flexible cable 1 further comprises an outer sheath 8 enveloping the filler layer 4 and directly applied on the same. The outer sheath 8 can be formed by extrusion, for example in a step subsequent to the extrusion of the filler layer 4, around the latter.

The outer sheath 8 comprises an annular body, longitudinally extending along the cable length, housing the filler layer 4 in its hollow part. The outer sheath 8 has an internal surface 9, facing the filler layer 4 external surface 6, and an external surface 10, radially opposite to the internal surface 9. In a cross section on a plane orthogonal to the cable 1 longitudinal axis, corresponding to the outer sheath 8 longitudinal axis, the external surface 10 defines an outer sheath external perimeter 11 forming a continuous closed curve. In an embodiment, the outer sheath external perimeter 11 corresponds to the cable external perimeter. Contrary to the filler layer 4 external perimeter 7, the outer sheath external perimeter 11 is devoid of vertices. In an embodiment, the outer sheath external perimeter 11 is substantially circular, wherein "substantially" is to be intended similarly to what discussed for the filler layer external perimeter 7, i.e. the outer sheath external perimeter 11 can be a regular circle or it can approximate it.

Due to the process for applying the outer sheath 8 onto the filler layer 4, particularly the extrusion, once the cable 1 is formed, the outer sheath 8 internal surface 10 substantially conforms to the filler layer external surface 6, particularly to the filler layer external perimeter 7. In other words, the outer sheath 8 internal surface 10 defines an outer sheath internal perimeter substantially forming the same closed polygonal chain formed by the filler layer external perimeter 7. Therefore, the filler layer external perimeter 7 vertices act as anchors for the outer sheath 8, which, as a consequence, is torsionally locked to the filler layer 4.

The filler layer 4 and/or the outer sheath 8 can be made of a polymer, preferably selected in the group consisting of: a cross-linked elastomer (such as: a synthetic rubber, Polychloroprene, Chlorosulfonated Polyethylene, a halogen-free cross-linked elastomer), a thermoplastic polymer (such as: Polyethylene, cross-linked Polyethylene, Polypropylene, Polyvinyl Chloride, Polyurethane, Polyester, a halogen-free thermoplastic polymer). The filler layer 4 and the outer sheath 8 can be made of any combination of the above-mentioned materials, even if not explicitly cited. Possible combinations, among others, are: filler layer 4 made of synthetic rubber and outer sheath made 8 of halogen-free cross-linked elastomer; filler layer 4 made of synthetic rubber and outer sheath made 8 of Polychloroprene; filler layer 4 made of Polyvinyl Chloride and outer sheath made 8 of Polyurethane; filler layer 4 made of Polyurethane and outer sheath made 8 of Polyurethane; both filler layer 4 and outer sheath 8 made of a cross-linked elastomer.

In an embodiment, the outer sheath 8 internal surface 9 is in direct contact with the filler layer 4 external surface 6 (FIG. 1).

In an embodiment, the cable 1 comprises an anti-swinging device at the interface of the outer sheath 8 internal surface 9 and the filler layer 4 external surface 6 (FIG. 2). Preferably, the anti-swinging device comprises one or more embedded threads 12 partially covering the filter layer 4 and acting as friction devices between the outer sheath 8 internal surface 9 and the filler layer 4 external surface 6.

What is claimed is:

1. A flexible cable for use in moving applications, the flexible cable comprising:

one or more insulated cores;

an extruded polymeric filler layer surrounding the one or more insulated cores, the filler layer having an external surface defining a filler layer external perimeter substantially forming a closed convex polygonal chain with a plurality of line segments connecting consecutive vertices; and an extruded polymeric outer sheath surrounding the filler layer and directly applied on the filler layer, having an external surface defining an outer sheath external perimeter forming a continuous closed curve.

2. The flexible cable of claim 1, wherein the outer sheath has an internal surface radially opposite to the outer sheath external surface, and wherein the outer sheath internal surface is in direct contact with and conforms to the filler layer external surface.

3. The flexible cable of claim 1, wherein the outer sheath has an internal surface radially opposite to the outer sheath external surface, the flexible cable further comprising an anti-swinging device at the interface of the outer sheath internal surface and the filler layer external surface.

4. The flexible cable of claim 3, wherein the anti-swinging device comprises one or more embedded threads.

5. The flexible cable of claim 1, wherein the line segments of the filler layer external perimeter are straight line segments or curved line segments.

6. The flexible cable of claim 5, wherein the curved line segments of the filler layer external perimeter are convex.

7. The flexible cable of claim 1, wherein the vertices of the filler layer external perimeter are shaped as points where two consecutive line segments meet.

8. The flexible cable of claim 1, wherein the vertices of the filler layer external perimeter are rounded.

9. The flexible cable of claim 1, wherein the number of vertices of the filler layer external perimeter is at least 4.

10. The flexible cable of claim 1, wherein the filler layer external perimeter substantially forms a regular octagon.

11. The flexible cable of claim 1, wherein the outer sheath external perimeter is substantially circular.

12. The flexible cable of claim 1, wherein the filler layer and the outer sheath are made of a polymer selected from the group consisting of:

a cross-linked elastomer including any of: a synthetic rubber, Polychloroprene, Chlorosulfonated Polyethylene, a halogen-free cross-linked elastomer;

a thermoplastic polymer including any of: Polyethylene, cross-linked Polyethylene, Polypropylene, Polyvinyl Chloride, Polyurethane, Polyester, a halogen-free thermoplastic polymer; and combinations thereof.

13. The flexible cable of claim 1, wherein the filler layer and the outer sheath are both made of a cross-linked elastomer.

14. A flexible cable for use in moving applications, the flexible cable comprising:

one or more insulated cores;

a filler layer surrounding the one or more insulated cores, the filler layer having an outer surface and a radially opposite inner surface; and an outer sheath surrounding the filler layer, the outer sheath directly contacting the outer surface of the filler layer, wherein, in a cross-sectional view, the outer surface of the filler layer is shaped like a polygon, the inner surface of the filler layer conforms to outer surfaces of the one or more insulated cores and shaped differently from the outer surface of the filler layer, and an outer surface of the outer sheath forming the external surface of the flexible cable is shaped like a circle.

15. A flexible cable for use in moving applications, the flexible cable comprising:

one or more insulated cores;

a filler layer surrounding the one or more insulated cores;

an outer sheath surrounding the filler layer, the outer sheath directly contacting an outer surface of the filler layer, wherein, in a cross-sectional view, the outer surface of the filler layer is shaped like a polygon and an outer surface of the outer sheath forming the external surface of the flexible cable is shaped like a circle; and an anti-swinging device at the interface between the outer sheath and the filler layer.

16. The flexible cable of claim 15, wherein the anti-swinging device comprises one or more embedded threads.

17. The flexible cable of claim 15, wherein the outer surface of the filler layer defines a filler layer external perimeter substantially forming a closed polygonal chain with a plurality of straight line segments connecting consecutive vertices.

18. The flexible cable of claim 15, wherein the outer surface of the filler layer defines a filler layer external perimeter substantially forming a closed convex polygonal chain with a plurality of curved line segments connecting consecutive vertices, and wherein the curved line segments of the filler layer external perimeter are convex.

19. The flexible cable of claim 1, wherein the one or more insulated cores comprises a power conductor having a conductor section of at least 25 $mm^2$.

20. The flexible cable of claim 14, wherein the one or more insulated cores comprises a power conductor having a conductor section of at least 25 $mm^2$.

21. The flexible cable of claim 1, wherein the one or more insulated cores define a cable core, the cable core comprising an outer surface comprising curved sections of outer surfaces of the one or more insulated cores, and wherein an inner surface of the filler layer comprises curved sections conforming to the curved sections of the outer surface of the cable core.

* * * * *